US006209327B1

(12) United States Patent
Keller et al.

(10) Patent No.: US 6,209,327 B1
(45) Date of Patent: Apr. 3, 2001

(54) BURNER ARRANGEMENT FOR A GAS TURBINE INCLUDING AN INLET-AIR IMPINGEMENT PLATE

(75) Inventors: Jakob Keller, deceased, late of Wohlen (CH), by Maria Keller-Schärli, Georg Keller, Vera Keller, legal representatives; Jochem Fischer, Marbach (DE); Ulf Christian Müller, Kirchdorf (CH); Frank Reiss, Lauchringen (DE); Pirmin Schiessel, Unterehrendingen (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/369,836

(22) Filed: Aug. 9, 1999

(30) Foreign Application Priority Data

Aug. 27, 1998 (EP) ..... 98810851

(51) Int. Cl.[7] ..... F02C 1/00
(52) U.S. Cl. ..... 60/760; 60/737
(58) Field of Search ..... 60/737, 760

(56) References Cited

U.S. PATENT DOCUMENTS 5,699,667 * 12/1997 Joos ..... 60/737

FOREIGN PATENT DOCUMENTS

| | | |
|---|---|---|
| 4436728A1 | 4/1996 | (DE) . |
| 0252315A1 | 1/1988 | (EP) . |
| 0692675A2 | 1/1996 | (EP) . |
| 0742411A2 | 11/1996 | (EP) . |
| 2422904 | 11/1979 | (FR) . |
| 05223109 | 8/1993 | (JP) . |

* cited by examiner

*Primary Examiner*—Charles G. Freay
*Assistant Examiner*—Ed Hayes
(74) *Attorney, Agent, or Firm*—Burns, Doane, Swecker & Mathis, L.L.P.

(57) ABSTRACT

A burner arrangement (20) for a gas turbine comprises an interior space (22) enclosed by a casing (23), in which interior space (22) at least one burner (21) is arranged, and into which interior space (22) in each case a jet (26, 27) of a gaseous medium, in particular air, is sprayed through at least two nozzle openings (24, 25) against the direction of flow of the burner (21) and along the inner wall (23*a*) of the casing (23) which jets (26, 27), guided by the inner wall (23*a*), meet one another from opposite directions and combine to form a secondary flow (28) flowing off perpendicularly from the inner wall (23*a*). In such a burner arrangement, the flow is stabilized and evened out by virtue of the fact that, to establish the impingement point of the jets (26, 27), a dividing plate (29) arranged in the flow path of the jets (26, 27) and disposed essentially perpendicularly to the inner wall (23*a*) is provided.

7 Claims, 2 Drawing Sheets

FIG. 1
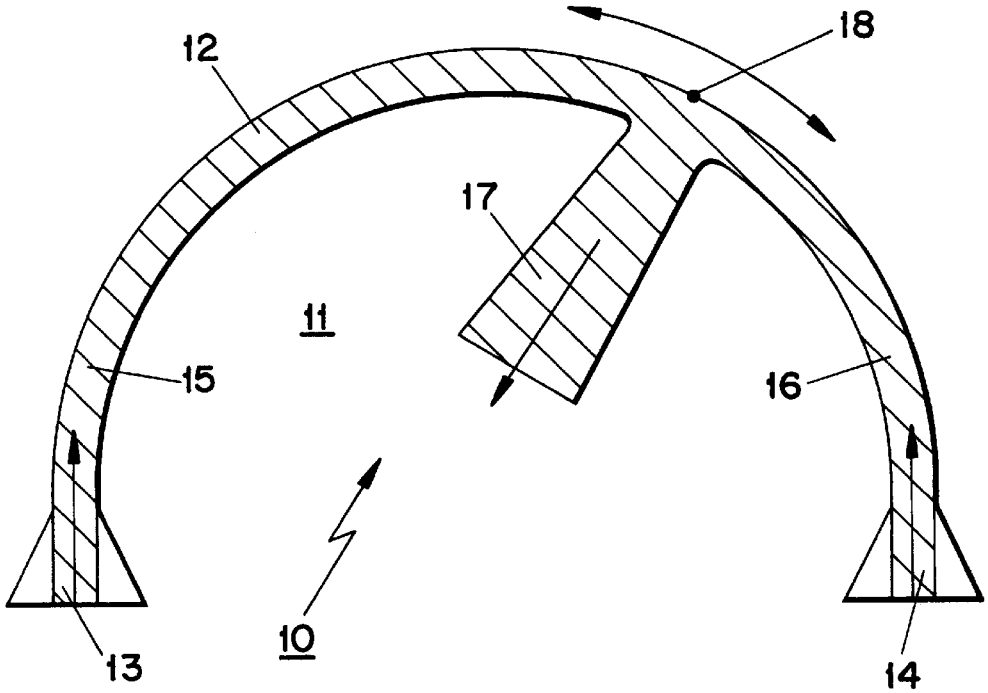
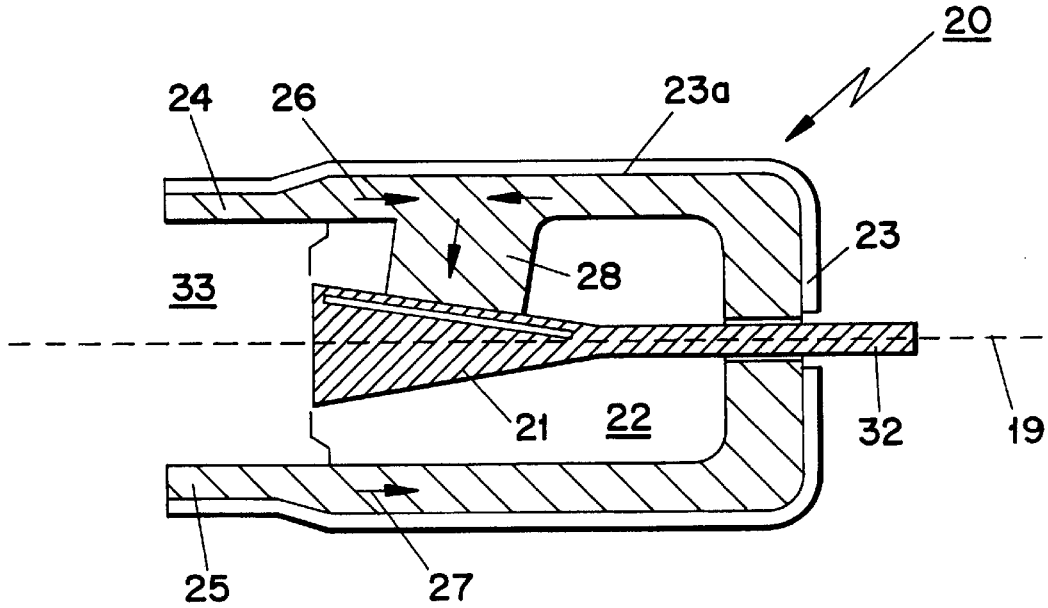
FIG. 2

FIG. 3
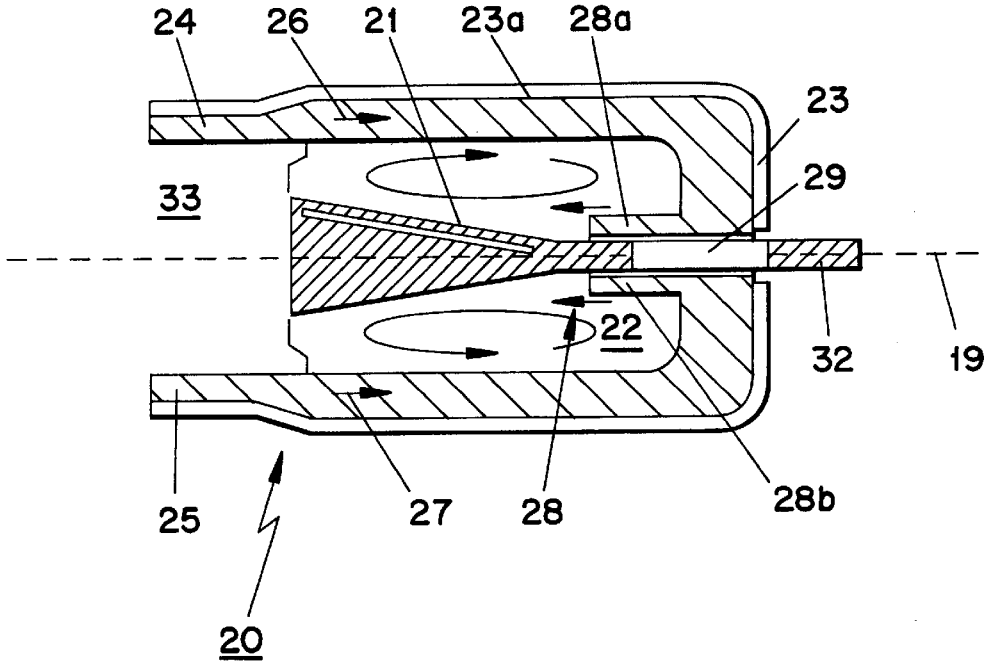
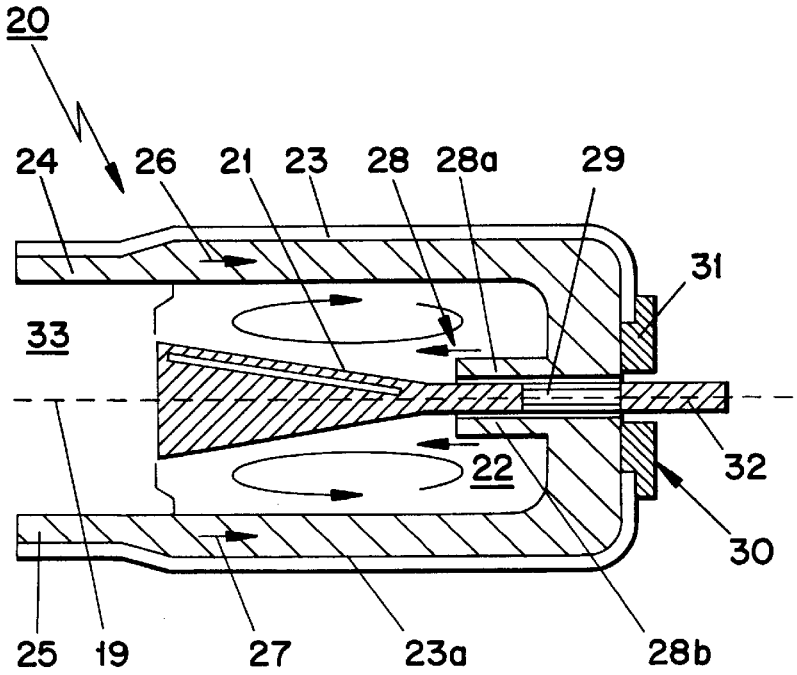
FIG. 4a
FIG. 4b
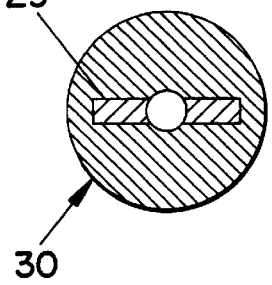

BURNER ARRANGEMENT FOR A GAS TURBINE INCLUDING AN INLET-AIR IMPINGEMENT PLATE

BACKGROUND OF THE INVENTION

1. Field of the Invention

The present invention relates to the field of gas-turbine technology. It relates to a burner arrangement for a gas turbine, where the burner arrangement comprises a interior space enclosed by a casing, in which interior space at least one burner is arranged, and into which interior space in each case a jet of a gaseous medium, in particular air, is sprayed through at least two nozzle openings against the direction of flow of the burner and along the inner wall of the casing, which jets, guided by the inner wall, meet one another from opposite directions and combine to form a secondary flow flowing off perpendicularly from the inner wall.

Such a burner arrangement has been disclosed, for example, by publication EP-A2-0 692 675 (see, for example, FIG. 1 there).

2. Discussion of Background

A double-cone burner of a gas turbine, to which double-cone burner fuel is fed via a fuel lance, is shown in the publication mentioned at the beginning (e.g. in FIG. 1 there). The burner is accommodated in the interior space of a dome-like casing. Main burner air flows into the casing against the direction of flow of the burner above and below the burner, is deflected by the inner wall of the casing and then enters the burner in order to be mixed with the fuel there.

Such a flow in a casing, which flow results from two or more jets striking one another, the jets entering the casing through corresponding nozzle openings, is generally extremely sensitive to fluctuations in the total pressure of the jets. This may be illustrated with reference to FIG. 1. In the flow arrangement 10 according to FIG. 1, two jets 15, 16 are sprayed on two opposite sides through corresponding nozzle openings 13, 14 into an interior space 11, which is defined by a boundary wall 12 (curved in a semicircle in this example), and these jets 15, 16—guided by the boundary wall 12—meet one another at an impingement point 18 and combine there to form a secondary flow 17, which is directed perpendicularly to the boundary wall into the interior of the interior space 11.

The velocity of the jets 15, 16 approaches zero at the impingement point 18. Since the wall streamlines of the two jets 15 and 16 meet at the stagnation point 18, the total pressures of the jets 15 and 16 must also correspond there. Since the friction at the boundary wall 12 typically does not lead to a rapid change in the total pressure, the impingement point 18 will regularly lie in the vicinity of one of the two nozzle openings 13, 14, which produce the jets 15, 16. In the extreme case, one of the jets 15, 16 may even block the nozzle opening which is intended to produce the other jet. Even in the cases in which the total pressures of the two jets are virtually the same, the position of the impingement point normally deviates greatly from the plane of symmetry which runs between the two nozzle openings.

This instability and uncertainty of such casing flows also has an effect in the case of a burner arrangement 20 as shown in FIG. 2. The burner 21 (in this case a double-cone burner of known type of construction) is accommodated in a casing 23 in such a way as to lie in a plane of symmetry 19. The burner 21 opens to the left into a combustion chamber 33; it is supplied with fuel from the right via a fuel feed 32.

Formed at the top and bottom between the combustion chamber 33 and the casing 23 are nozzle openings 24 and 25, through which combustion air (from the compressor of the gas turbine) is sprayed in the form of jets 26, 27 into the interior space 22 enclosed by the casing 23. The jets 26, 27 flow toward one another along the inner wall 23*a* of the casing 23 and, after striking one another, combine to form a secondary flow 28, which flows toward the burner 21 and enters the burner 21 laterally. As indicated in FIG. 2, the impingement point and thus also the secondary flow generally lie at a varying point outside the plane of symmetry, which point cannot be predetermined and may change quickly due to geometric disturbances in the arrangement and due to pressure fluctuations. As a result, the uniform operation of the burner 21 under stable combustion conditions is considerably impaired.

SUMMARY OF THE INVENTION

Accordingly, one object of the invention is to provide a novel burner arrangement in which stable flow conditions of the sprayed-in combustion air result, these flow conditions being essentially unaffected by geometric deviations and pressure fluctuations.

The object is achieved in a burner arrangement of the type mentioned at the beginning in that, to establish the impingement point of the jets, a dividing plate is placed in the flow path of the jets and arranged essentially perpendicular to the inner wall. The two jets strike the dividing plate, mounted in a fixed position, from both sides and are deflected parallel to the dividing plate into the interior space, where they are combined behind the dividing plate to form a secondary flow, which flows parallel to the dividing plate.

Depending on the arrangement of the dividing plate, the secondary flow may be produced at different points of the casing and with different directions. However, a preferred embodiment of the invention is defined in that the burner is arranged inside the casing in a plane of symmetry, in that the nozzle openings are arranged symmetrically to the plane of symmetry, and in that the dividing plate lies in the plane of symmetry.

Further embodiments follow from the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a schematic representation of a basic flow arrangement having two wall-guided flows striking one another at an impingement point;

FIG. 2 shows a schematic representation of a burner arrangement having jets of combustion air according to the prior art which are directed inside a casing;

FIG. 3 shows a first preferred exemplary embodiment of a burner arrangement according to the invention having a dividing plate fastened directly to the casing; and FIGS. 4A,B show a second preferred exemplary embodiment of a burner arrangement according to the invention having an interchangeable burner in side view (FIG. 4A), in which burner arrangement the dividing plate is fastened to a cover of an access opening for the burner (plan view of the cover with dividing plate in FIG. 4B).

DESCRIPTION OF THE PREFERRED EMBODIMENTS

Referring to the drawings, wherein like reference numerals designate identical or corresponding parts throughout the several views, a first preferred exemplary embodiment of the burner arrangement according to the invention, based on the representation from FIG. 2, is reproduced in FIG. 3. In this case, the same parts of the arrangement are provided with the same reference numerals as in FIG. 2. Essential to the invention is the insertion of a dividing plate 29 into the burner arrangement. In the exemplary embodiment in FIG. 3, the dividing plate 29 lies in the plane of symmetry 19 and can therefore only be seen from the side. The dividing plate 29 is placed perpendicularly on the inner wall 23*a* of the casing 23 and is preferably mounted in a fixed position at this point on the inner wall 23*a*, e.g. welded or screwed thereto. It is at the same time disposed perpendicularly to the jets 26 and 27 striking the dividing plate 29 at this point from both sides. Due to the effect of the dividing plate 29, two partial flows 28*a* and 28*b* form at the location defined by the dividing plate 29, and these partial flows 28*a* and 28*b* flow along the dividing plate 29 into the interior of the interior space 22 and combine at the end of the dividing plate 29 to form a secondary flow 28. The dividing plate 29 according to the invention, at a defined point of the casing 23, in particular in the plane of symmetry 19, thus produces a secondary flow of defined direction, which meets the burner 21 symmetrically from the rear and essentially retains its configuration, even in the event of changes in the rest of geometry or in the pressures. In this way, very stable conditions are achieved during operation of the burner.

If, as assumed in FIG. 3, a burner 21 is installed in a fixed position in the casing 23, the dividing plate 29 may be fastened directly to the inner wall 23*a* of the casing 23 without difficulty. If, for example, a plurality of burners are arranged side by side in an interchangeable manner in the casing 23, and these burners, according to FIGS. 4A and B, are designed such that they can be pushed in or pulled out through an access opening 31 in the casing 23, the access opening 31 being closable by an appropriate (disk-shaped) cover, the dividing plate 29 may be advantageously arranged and fastened on the inside of the cover 30.

It has been possible to experimentally confirm the effect of such dividing plates in stabilizing and evening out the combustion-air flow in gas turbines of type GT13E2 from the applicant.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner arrangement for a gas turbine, which burner arrangement comprises an interior space enclosed by a casing, in which interior space at least one burner is arranged, and into which interior space in each case a jet of a gaseous medium is sprayed through at least two nozzle openings against the direction of flow of the burner and along the inner wall of the casing, which jets, guided by the inner wall, meet one another from opposite directions and combine to form a secondary flow flowing off perpendicularly or quasiperpendicularly from the inner wall, wherein, to establish the impingement point of the jets, a dividing plate arranged in the flow path of the jets and disposed essentially perpendicularly to the inner wall is provided.

2. The burner arrangement as claimed in claim 1, wherein the burner is arranged inside the casing in a plane of symmetry, wherein the nozzle openings are arranged symmetrically to the plane of symmetry, and wherein the dividing plate lies in the plane of symmetry.

3. The burner arrangement as claimed in claim 1, wherein the dividing plate is fastened directly to the casing.

4. The burner arrangement as claimed in claim 1, wherein the burner is designed to be interchangeable inside the casing, wherein an access opening for pulling out the burner and/or for inserting the burner is provided in the casing, which access opening can be closed by a cover, and wherein the dividing plate is fastened to the cover.

5. The burner arrangement as claimed in claim 1, wherein the jets striking one another form the secondary flow radially or quasi-radially from the inner wall.

6. The burner arrangement as claimed in claim 1, wherein the upright dividing plate runs radially or quasi-radially.

7. The burner arrangement as claimed in claim 1, wherein the gaseous medium is air.

* * * * *